US007318544B2

(12) United States Patent
Zahner et al.

(10) Patent No.: US 7,318,544 B2
(45) Date of Patent: Jan. 15, 2008

(54) SETTING TOOL

(75) Inventors: Mario Zahner, Chur (CH); Iwan Wolf, Chur (CH); Dierk Tille, Scheidegg (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/225,729

(22) Filed: Sep. 12, 2005

(65) Prior Publication Data

US 2006/0054652 A1 Mar. 16, 2006

(30) Foreign Application Priority Data

Sep. 13, 2004 (DE) ..... 10 2004 044 156

(51) Int. Cl.
*B25C 1/08* (2006.01)
*B25C 1/12* (2006.01)
*B25C 1/16* (2006.01)

(52) U.S. Cl. ..... 227/10; 227/9; 227/11

(58) Field of Classification Search ..... 227/8, 227/9, 10; 123/46 SC, 46 H
See application file for complete search history.

(56) References Cited

U.S. PATENT DOCUMENTS 4,609,135 A * 9/1986 Elliesen ..... 227/130
5,199,626 A * 4/1993 Terayama et al. ..... 227/10
6,679,410 B2 1/2004 Wuersch
6,695,192 B1 2/2004 Kwok
6,763,897 B2 * 7/2004 Hanke et al. ..... 173/210
2002/0108989 A1 * 8/2002 Ehmig ..... 227/10

FOREIGN PATENT DOCUMENTS

DE 3930592 9/1990
FR 2816539 5/2002

* cited by examiner

*Primary Examiner*—Rinaldi I. Rada
*Assistant Examiner*—Nathaniel Chukwurah
(74) *Attorney, Agent, or Firm*—Abelman, Frayne & Schwab

(57) ABSTRACT

A setting tool for driving fastening elements in a constructional component includes a piston guide (11) adjoining the tool combustion chamber (16), a setting piston (20) arranged in the hollow space (12) of the piston guide (12) for an axial displacement therein, a piston stopping element (30) for the setting piston (20) and arranged in an end region (17) of the hollow space (12) remote from the combustion chamber (16), and a device (40) for axially displacing the piston stopping element (30) in the hollow space (12).

8 Claims, 4 Drawing Sheets

SETTING TOOL

BACKGROUND OF THE INVENTION

1. Field of the Invention

The present invention relates to a setting tool for driving fastening elements in a constructional component and including a combustion chamber, a piston guide adjoining the combustion chamber, a setting piston arranged in the hollow space of the piston guide for an axial displacement therein, and a piston stopping element for the setting piston and arranged in an end region of the hollow space remote from the combustion chamber.

2. Description of the Prior Art

Setting tools of the type discussed above can be driven using solid, gaseous, or liquid fuels, or a compressed air.

In the above-described setting tools in which a piston drives a fastening element in a constructional component, generally, pressure is applied to the piston at the piston end opposite the fastening element. In the combustion-engined setting tools, the piston is driven, e.g., by combustion gases. Under the pressure acting on the piston, the piston is accelerated in the direction of the fastening element, impacts the fastening element, and drives it in the constructional component.

Sometimes it is desirable that the fastening element is not always driven in a constructional component to the same depth. When the constructional component is soft, e.g., a fastening element would be driven, under the same condition, deeper than when it would have been driven in a hard component. This can result in the damage of the material into which the fastening element is driven in.

In a setting tool Hilti GX100 of the assignee herein, a setting piston is guided in a piston guide, and a bolt guide adjoins the piston guide in the driving-in direction. At the end of the piston guide adjacent to the bolt guide, there is provided a buffer element for the setting piston that limits the displacement of the piston in the driving-in direction. On the bolt guide, a press-on sleeve is provided that can be displaced along the bolt guide between two positions, defining two stages. The press-on sleeve permits to get a maximum drive-in depth.

The drawback of the known setting tool consists in that with the press-on sleeve being mounted on the bolt guide, the outer dimensions of the setting tool are increased, which constrains the to-be-handled profiles.

Accordingly, an object of the present invention is to provide a setting tool of the type described above in which the foregoing drawback is eliminated.

Another object of the present invention is a setting tool of the type described above and in which adjustment of the drive-in depth can be effected to a most possible extent.

SUMMARY OF THE INVENTION

These and other objects of the present invention, which will become apparent hereinafter, are achieved by providing in the setting tool a device for axially displacing the piston stopping element in the hollow space of the guide spindle.

The displacing device permits to continuously or stepwise adjust the position of the piston stopping element or the support with the piston stopping element in the direction of the longitudinal axis of the piston guide. With the device, a maximum possible stroke of the setting piston and, thereby, a maximum possible drive-in depth can be changed, without increasing, in the mouth region of the setting tool, the dimensions of the bolt guide by additional elements or components. The piston stopping element can be formed, e.g., as a buffer element from rubber, or from metal.

Advantageously, there is provided a support for the piston stopping-element which is adjustably arranged in the end region of the hollow space of the piston guide. The support offers a constructively easy solution for replacing the attached thereto, piston stopping element.

Advantageously, the support and/or the piston stopping element are rotatably supported about the longitudinal axis of the piston guide. This permits to effect an axial adjustment by rotating the support and/or the piston stopping element.

It is advantageous when the displacement device includes first and second support surfaces provided on the support for the piston stopping element and ramp surfaces provided between the first and second support surfaces, and spaced first and second counter-support surfaces provided on an end surface of the piston guide and counter-ramp surfaces provided between the first and second counter-support surfaces. The axial distance between the end wall of the piston guide and the support can be adjusted by appropriate positioning of the support and counter-support surfaces. Advantageously, the displacing device displaces the piston stopping element back and forth in the hollow space of the piston guide between two axially spaced positions.

The displacing device can include at least one actuation member with which it can be manually actuated. The actuation member can be formed, e.g., as a lever which is fixedly connected with a bearing section of the support.

It is advantageous when in the first position of the piston stopping member, the first support surface abuts the second counter-support surface, and the second support surfaces abuts the first counter-support surfaces, and in the second position of the piston stopping member, the second support surfaces abuts the second counter-support surfaces.

The first and second support surfaces and/or the first and second counter-support surfaces are axially spaced from each other, respectively, and are separated from each other with ramp surfaces and counter-ramp surfaces. Upon rotation, the opposite and sliding over each other ramp surfaces and counter-ramp surfaces cause an axial translational movement of the support and/or of the piston stopping element. In this way, the two axially spaced positions of the support and/or of the piston stopping element can be defined in a technically simple manner.

Advantageously, the first and second support surfaces and counter-support surfaces extend transverse to a longitudinal axis of the piston guide, i.e., they extend, during the setting process, parallel to the constructional component. Thereby, when the setting piston strikes the piston stopping member, only reaction forces acting in the direction of the tool axis or the longitudinal axis of the piston guide are generated. Rotation of the support does not take place during the setting process.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
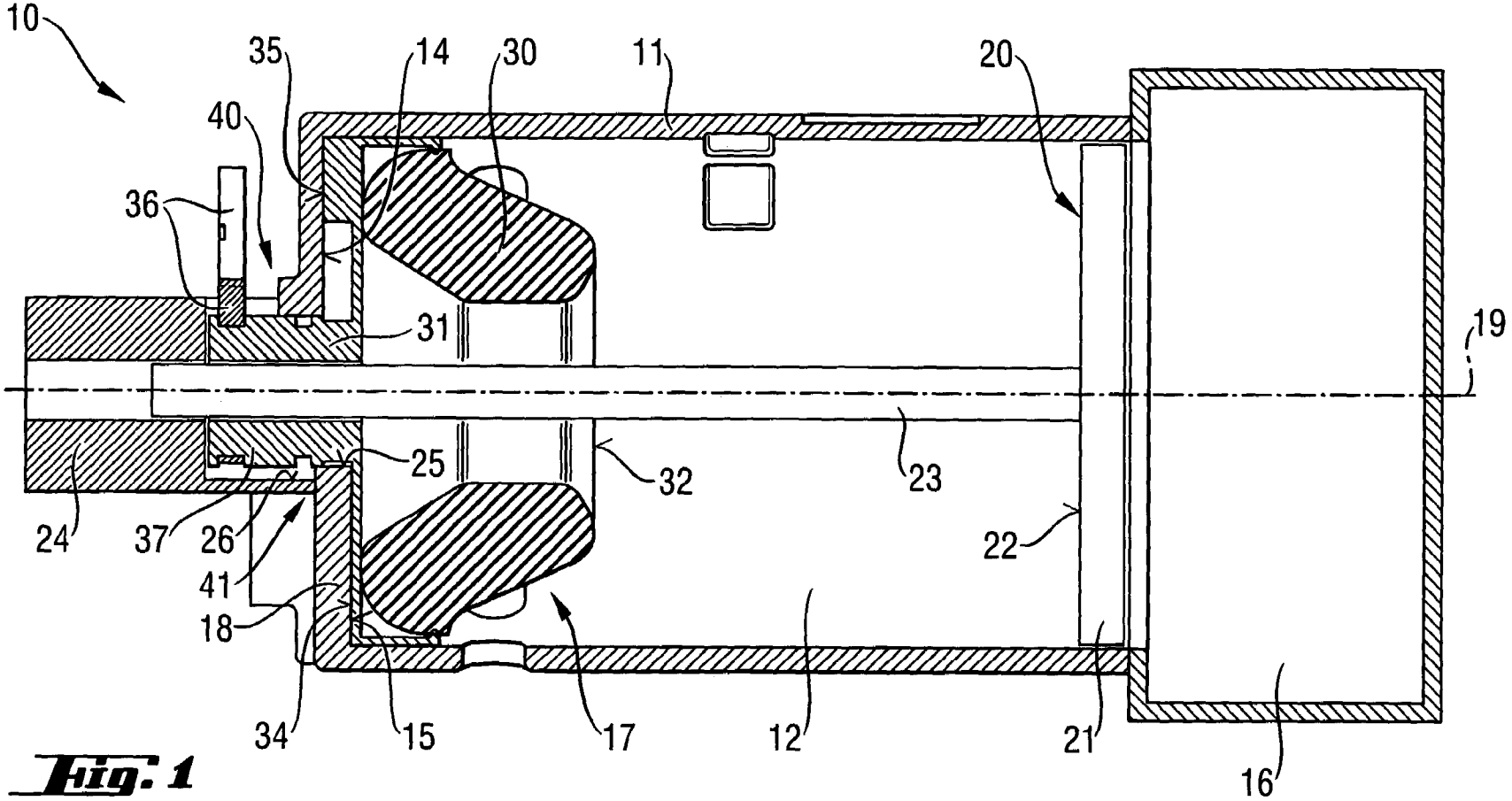
FIG. 1 a longitudinal cross-sectional view of a setting tool according to the present invention with a piston stopping device in a first position thereof.

A hand-held, combustion-engined, setting tool 10 according to the present invention, which is shown in FIGS. 1 through 5, has a combustion chamber 16 and a piston guide 11 that adjoins the combustion chamber 16. A setting piston 20 is displaceably arranged in the hollow space 12 of the piston guide 11. The setting piston 20 is driven by combustion gases which are produced upon combustion of a fuel in the combustion 16. A bolt guide 24 adjoins the piston guide 11 at its end remote from the combustion chamber 16. The bolt guide 24 extends coaxially with the piston guide 11. In the end region 17 of the hollow space 12 of the piston guide 11 adjacent to the bolt guide 24, there is arranged a piston stopping element 30. The piston stopping element 30 is supported on a support 31 which is rotatably supported, with its bearing section 37, in the opening 25 of the piston guide 11 and/or in an opening 26 of the bolt guide 24 that adjoins the piston guide opening 25. The bearing section 37 is supported for an axial displacement along a longitudinal axis 19 of the piston guide 11. At a side thereof adjacent to the setting piston 20, the piston stopping element 30 is provided with a stop surface 32 for the setting piston 20. The setting piston 20 has a piston body 23 and piston head 21 which is provided at the end of the setting piston 20 adjacent to the combustion chamber 16 and is fixedly connected with the piston body 23. The piston head 21 has a counter-stop surface 22 facing in the direction of the piston stopping element 30 that can abut the stop surface 32 of the piston stopping element 30 upon displacement in the direction of the piston stopping element 30. Thus, the piston stopping element limit the maximal stroke of the setting piston 20.

Figure 5:
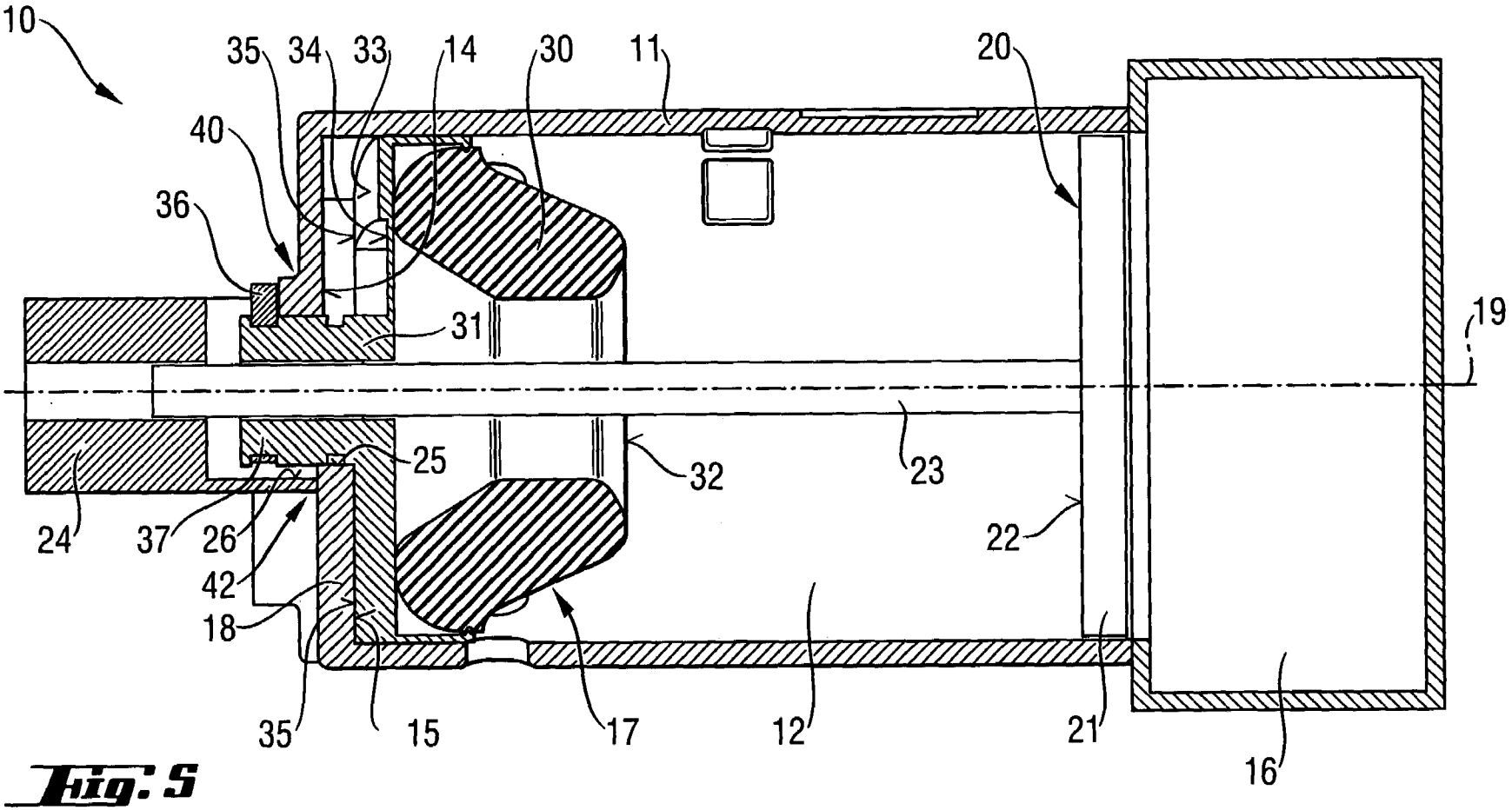
FIG. 5 a longitudinal cross-sectional view of the setting tool shown in FIG. 1 with the piston stopping device in a second position thereof.

With a device which is generally designated with a reference numeral 40, the piston stopping element 30 and the support 31 are displaced from a first position 41 which is shown in FIG. 1 and in which the maximum possible stroke of the piston 20 is the greatest, to a second position 42 which is shown in FIG. 5 and in which the maximum possible stroke of the setting piston 20 is the smallest. Thus, the device 40 permits to adjust, in a simple manner, a maximum possible drive-in depth. The displacing device 40 includes first support surfaces 34 and second support surfaces 35 which are provided on a side of the support 31 adjacent to the bolt guide 24. The arrangement of support surfaces 34 and 35 can be seen in FIG. 3. The second support surfaces 35 project beyond the firs support surfaces 34 in the axial direction. All of the first support surfaces 34 and all of the second support surfaces 35 lie in the same respective planes. Between a first support surface 34 and an adjacent thereto, second support surface 35, there is provided an ascending ramp surface 33 extending from the first support surface 34. An actuation member 36, which is formed as a lever is connected with the bearing section 37 of the support 31 for joint rotation therewith. The actuation member 36 is accessible to the tool operator and can be operated manually.

Figure 2:
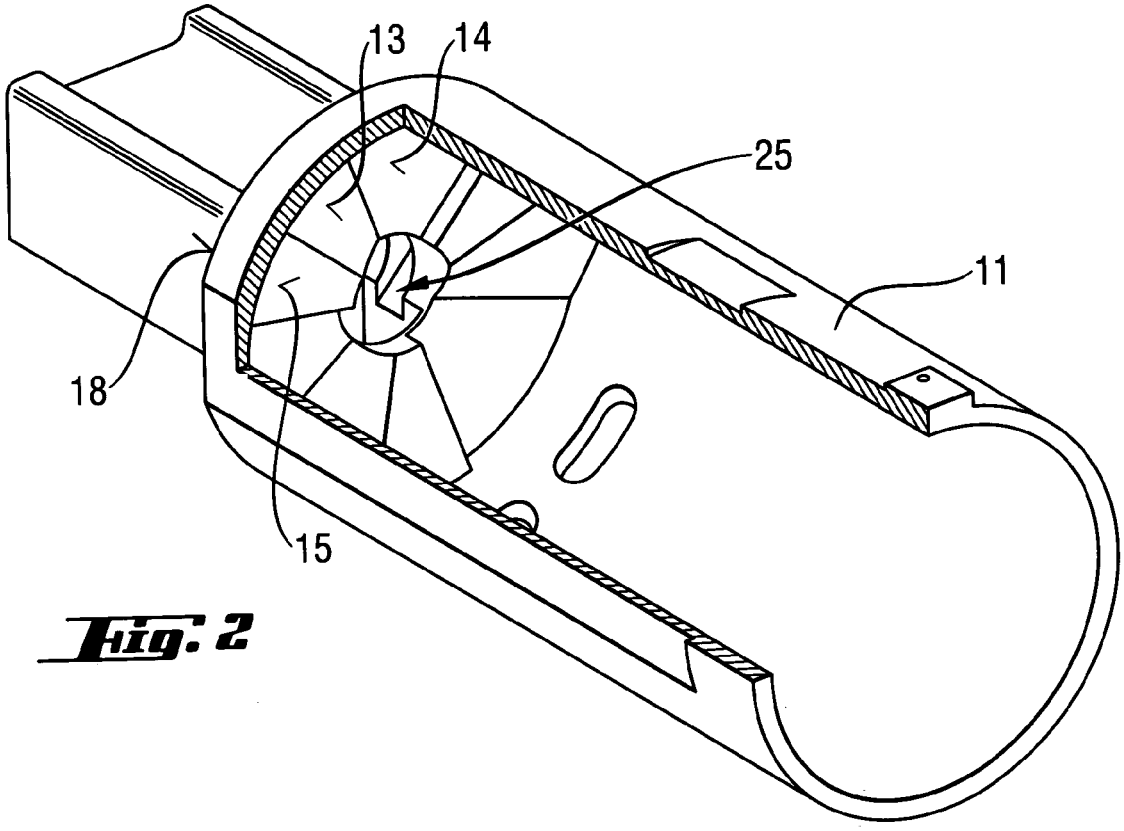
FIG. 2 a perspective, partially cross-sectional view of a detail of the setting tool shown in FIG. 1.
Figure 3:
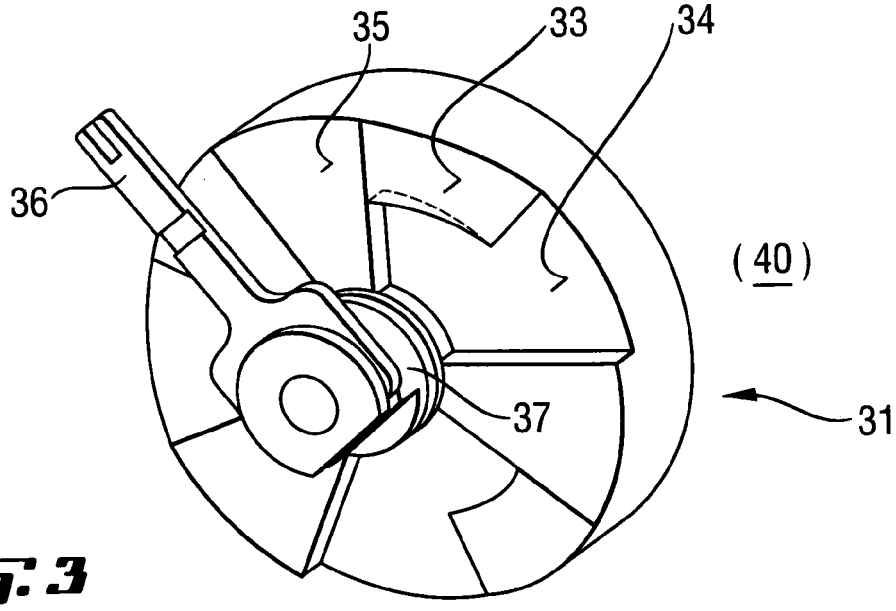
FIG. 3 a perspective view of a further detail of a setting tool shown in FIG. 1.
Figure 4:
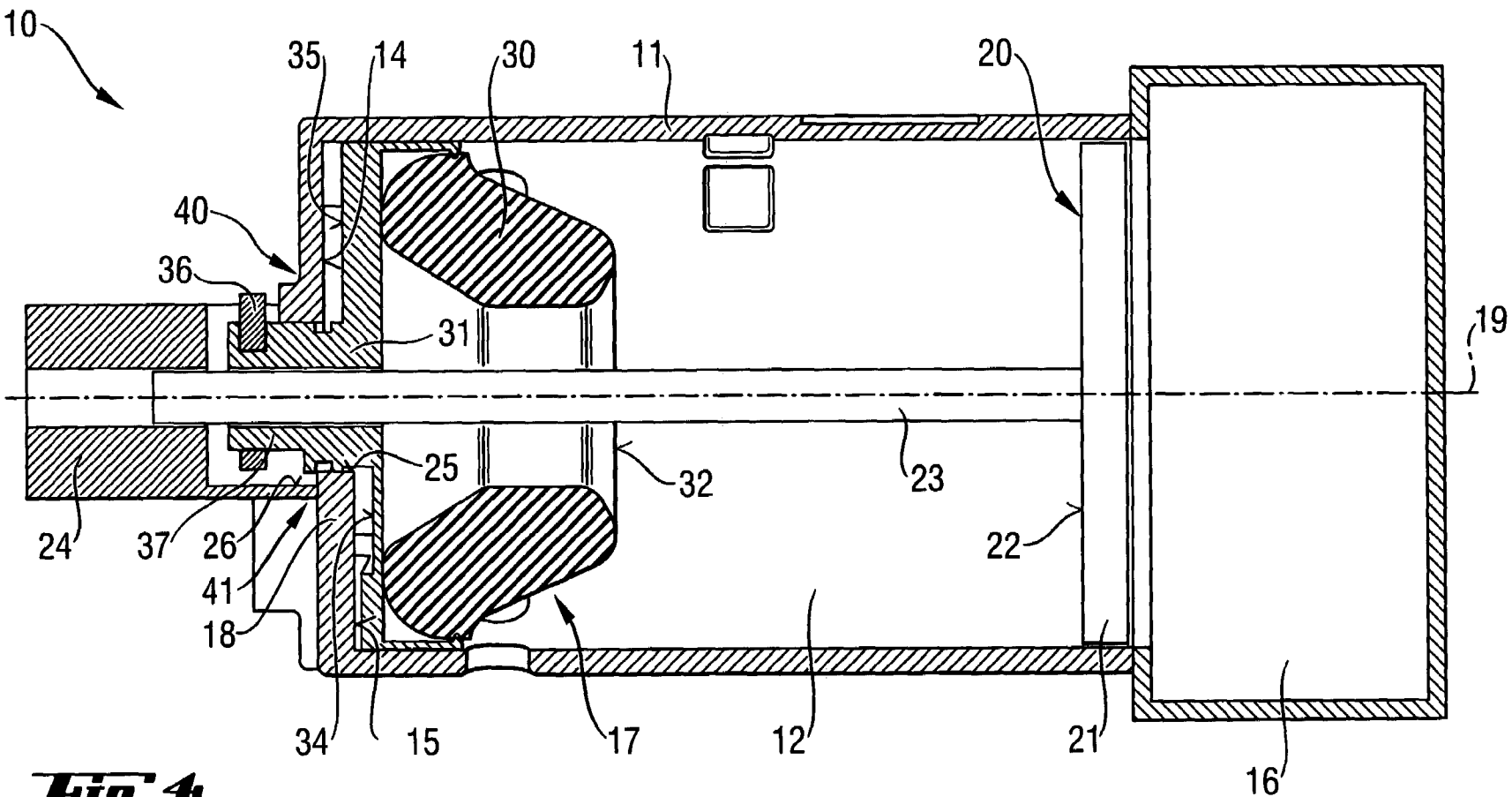
FIG. 4 a longitudinal cross-sectional view of the setting tool shown in FIG. 1 with the stopping device in an intermediate position thereof.

As particularly shown in FIG. 2, on end wall 18 of the piston guide 11, there are provided first counter-support surfaces 14 and second counter-support surfaces 15 of the device 40. The second counter-support surfaces 15 project beyond the first counter-support surface 14 in the axial direction. All of the first counter-support surfaces 14 and all of the second counter-support surfaces 15 lie, respectively, in the same planes. An ascending counter-ramp surface 13 is provided from the first counter-support surface 14 to the second counter-support surface 15.

As shown in FIG. 1, in the first position 41 of the device 40, the first support surfaces 34 of the support 31 abut the second counter-support surfaces 15 on the end wall 18 and the second support surfaces 35 of the support 31 abut the first counter-support surface 14 on the end wall 18. Upon actuation of the device 40 by pivoting the actuation member 36 about the longitudinal axis 19, the support surface 31 pivots, together with the piston stopping element 30, in the pivotal direction of the actuation member 36. The ramp surfaces 33 slide along counter-ramp surfaces 13 on the end wall 18, and the support 31 is lifted by some distance from the end wall 18 in a direction of the combustion chamber 16.

In the position 42 shown in FIG. 5, the actuation member 36 has been completely pivoted up to a stop not designated with a reference numeral. In this position of the actuation member 36, the second support surfaces 35 of the support 31 abut the second counter-support surfaces 15 on the end wall 18. The piston stopping element 30 and the support 31 became displaced by a certain distance in a direction toward the combustion chamber 18, so that the maximum displacement path of the setting piston 20 has been shortened. Thereby, the maximum drive-in depth has also been reduced, as the setting piston 20, contrary to the first position 41 (see FIG. 1), will be displaced by a shorter distance until it strikes the piston stopping element 30 upon actuation of the setting tool 10 with an actuation switch (not shown).

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving a fastening element in a constructional component, comprising:

a combustion chamber (16);

a piston guide (11) adjoining the combustion chamber (16) and having a hollow space (12);

a setting piston (2) arranged in the hollow space (12) of the piston guide (11) for an axial displacement therein;

a piston stopping element (30) for the setting piston (20) and arranged in an end region (17) of the hollow space (12) of the piston guide (11) remote from the combustion chamber (16); and a means (40) for axially displacing the piston stopping element (30) in the hollow space (12) for adjusting the maximum possible drive-in depth.

2. A setting tool according to claim 1, further comprising a support (31) for the piston stopping element (30) and arranged in the end region of the hollow space (12) of the piston guide (11), the device (40) displacing the support (31).

3. A setting tool according to claim 2, wherein at least one of the piston stopping element (30) and the support (31) are supported for pivotal movement about a longitudinal axis of the piston guide (11).

4. A setting tool according to claim 2, wherein the displacing device (40), comprises spaced first and second support surfaces (34, 35) provided on the support (31) for the piston stopping element (30) and ramp surfaces (33) provided between the first and second support surfaces (34, 35), and spaced first and second counter-support surfaces (14, 15) provided on an end surface (18) of the piston guide (11) and counter-ramp surfaces (13) provided between the first and second counter-support surfaces (14, 15).

5. A setting tool according to claim 4, wherein the first and second support surfaces (34, 35) and counter-support surfaces (14, 15) and counter-support surfaces (14, 15) extend transverse to a longitudinal axis (19) of the piston guide (11).

6. A setting tool according to claim 1, wherein the displacing device (40) displaces the piston stopping element (30) back and forth in the hollow space (12) of the piston guide (11) between axially spaced first (41) and second (42) positions.

7. A setting tool according to claim 6, wherein the first position (41) of the piston stopping element (30), the first support surfaces (34) abut the second counter-support surfaces (15), and the second support surfaces (35) abuts the first counter-support surfaces (14), and in the second position (42) of the piston stopping element (30), the second support surfaces (35) abuts the second counter-support surfaces (15).

8. A setting tool according to claim 1, wherein the displacing device (40) comprises at least one actuation element (36) for manually actuating the device (40).

* * * * *